United States Patent [19]

Crownover

[11] 4,054,696

[45] Oct. 18, 1977

[54] ARTIFICIAL AND MECHANICAL TREE

[76] Inventor: Frederick Scott Crownover, Rte. 1, Box 27, Columbiana, Ala. 35051

[21] Appl. No.: 770,434

[22] Filed: Feb. 22, 1977

[51] Int. Cl.[2] ..... A47G 33/06

[52] U.S. Cl. ..... 428/9; 211/196; 248/435; 403/50; 428/12; 428/20

[58] Field of Search ..... 211/196, 205; 248/435; 156/61; 428/7, 8, 9, 12, 18, 19, 20; 240/36, 10 P, 10 T, 10 Q; 285/226; 403/50

[56] References Cited

U.S. PATENT DOCUMENTS

| | | | |
|---|---|---|---|
| 2,586,791 | 2/1952 | Dattilo | 428/18 X |
| 2,796,517 | 6/1957 | Herzfelder | 428/12 X |
| 3,219,512 | 11/1965 | Kovacevic | 428/19 X |
| 3,336,950 | 8/1967 | Fochler | 285/226 X |
| 3,679,528 | 7/1972 | Spiegel | 428/18 X |

*Primary Examiner*—George F. Lesmes
*Assistant Examiner*—Henry F. Epstein
*Attorney, Agent, or Firm*—Frederick L. Bergert

[57] ABSTRACT

An artificial and mechanical tree which includes a pole member and a plurality of vertical, accordion-type limb sections is disclosed. Each of the tree limb sections has the tree limbs attached to a vertically collapsible and expandable tubular member which is concentric with and removably attached in the expanded configuration to the pole member.

5 Claims, 6 Drawing Figures

ARTIFICIAL AND MECHANICAL TREE

BACKGROUND AND SUMMARY OF THE INVENTION

The present invention relates to an artificial and mechanical tree. More particularly, the present invention relates to an artificial and mechanical tree, including a plurality of sections which may be expanded vertically to provide a fully formed tree such as a Christmas tree.

Various artificial trees which are constructed in sections are known in the prior art, including such trees as those described in U.S. Pat. No. 1,555,621 to Barker and U.S. Pat. No. 3,970,834 to Smith. In the Barker patent, there is described an artificial tree having a plurality of vertical sections connected by ferrules, with some of the ferrules being provided with sockets for supporting the branches. The Smith patent is concerned with an artificial tree having specific means for securing together the plurality of tree sections.

By the present invention, there is provided an improved artificial and mechanical tree which is constructed in sections and which is capable of being formed into a fully formed tree having a conical configuration, for example, such as a Christmas tree.

The artificial and mechanical tree of the present invention includes a base member having attached thereto a pole member which may be constructed of a plurality of detachable sections. The outer portion of the tree is constructed of accordion-type tree limb sections, and each of these sections includes a plurality of tree limbs which are connected to and extend outwardly from a vertically collapsible and expandable accordion-type tubular member. The tubular member of each tree limb section is provided with a means for attaching said tree limb section to the pole member in the expanded configuration with the result that, when all tree limb sections are so attached, a fully formed tree is thereby obtained.

BRIEF DESCRIPTION OF THE DRAWINGS

The advantages and features of the artificial and mechanical tree of the present invention will be more fully understood from the following description of the preferred embodiments, taken in conjunction with the accompanying drawings, wherein.

DESCRIPTION OF THE PREFERRED EMBODIMENTS

Figure 1:
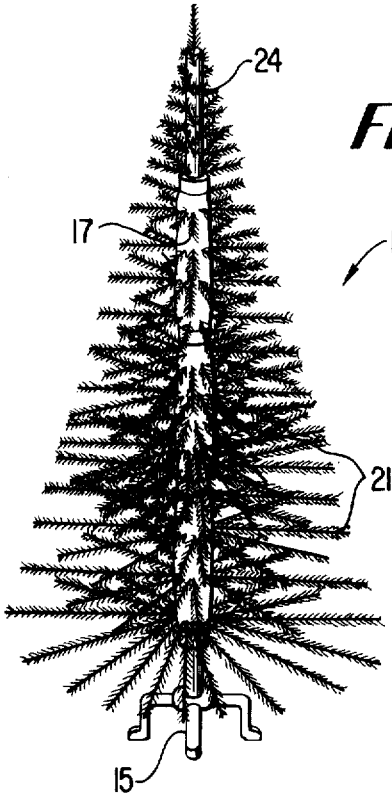
FIG. 1 is a perspective view of an artificial and mechanical tree of the present invention, with each of the vertical sections shown in the fully formed or expanded configuration.
Figure 2:
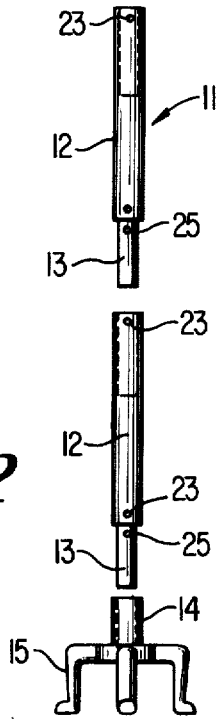
FIG. 2 is an exploded perspective view of the pole section construction of the tree of FIG. 1.

In the illustrated embodiment of the present invention as shown in FIGS. 1 through 6, there is provided an artificial and mechanical tree 10, which includes a pole element 11 formed of a plurality of pole sections 12. Each of the pole sections 12 is of tubular construction, having a tapered lower portion 13 to allow a particular section 12 to fit into the adjacent section 12 immediately below. The lowermost pole section 12 has its tapered lower end 13 fitted into a raised tubular portion 14 of the stand 15. The tapered portion 13 of each section 12 which fits within the section 12 below is preferably of a length such as about 10 inches, for example, in order to provide strength to the pole 11 when the sections are joined. The number of pole sections 12 employed will depend, of course, on the desired size of the tree, and trees of various heights and circumferences may be constructed depending upon the number of sections 12 employed. The pole sections 12 are provided with holes 23 which extend horizontally through the upper and lower end portion of each section 12 for attachment of additional elements of the tree 10, as described hereinafter. In addition, each lower portion 13 is provided with a hole 25 which is aligned with a corresponding hole 23 in the upper end of the section 12 below.

Figure 3:
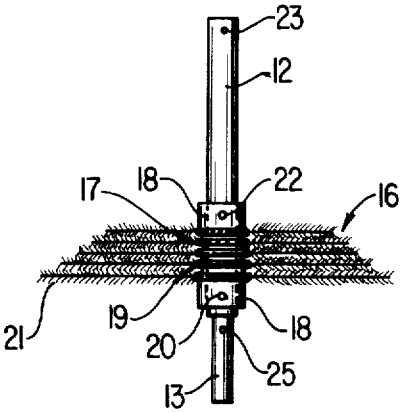
FIG. 3 is a perspective view of one of the accordion-type tree limb sections prior to expansion.
Figure 4:
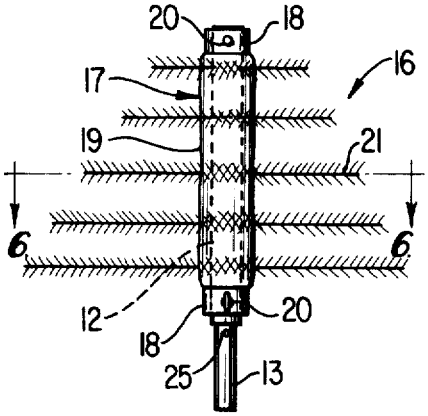
FIG. 4 is a perspective view showing the accordion-type section of FIG. 3 in the expanded configuration.
Figure 5:
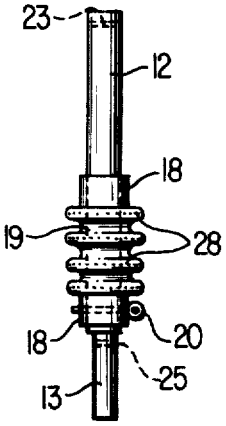
FIG. 5 is a perspective view of the accordion-type member employed in the tree limb section of FIGS. 3 and 4, but without the tree limbs.

Shown in FIGS. 3 and 4 is an accordion-type tree limb section 16, with one of these sections 16 encompassing and being attached to each of the sections 12 of the pole 11 in order to provide the shape and configuration of a tree. Each tree limb section 16 includes a generally tubular member 17 having upper and lower sleeves 18 connected by a tubular section 19 of a vertically collapsible and expandable accordion-type material. The tubular member 17 has a diameter slightly larger than that of the pole sections 12, to allow the tubular member 17 to fit over the pole sections 12. The accordion-type material of section 19 may be rubber, plastic or any other conventional natural or synthetic material which is capable of being constructed with accordion-like bends or pleats, as shown in FIG. 5, and which can be expanded vertically in accordion-like fashion, as shown in FIG. 4, for attachment to one of the pole sections 12.

Figure 6:
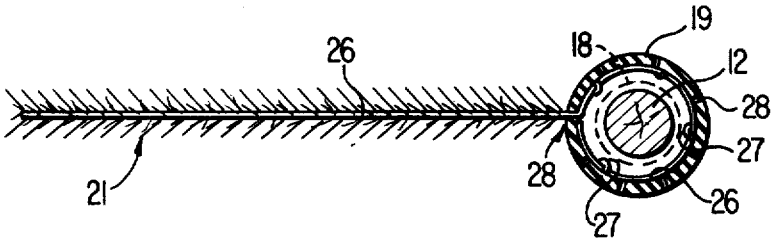
FIG. 6 is a partial sectional view taken along line 6—6 of FIG. 4.

Each tree limb section 16 further includes a plurality of artificial tree limbs 21, formed of any lightweight artificial fiber which resembles a tree branch, and with the inner end of each limb 21 being attached by adhesive sealing material or other suitable means to accordion-type section 19. In attaching the limbs 21 to a section 19, the desired overall shape of the finished tree should be kept in mind. Thus, for example, in the case of a Christmas tree, the limbs 21 attached to the lower portion of each section 19 should be of a greater length than the limbs attached at the upper portion of a section 19, and with the length of limbs 21 varying gradually from bottom to top so that the finished tree will have the generally conical shape of a Christmas tree. In attaching the limbs 21 to an individual accordion-type section 19, it may be desirable to perforate the surface of the section 19 and to place the inner end of each limb 21 through one of the perforation or holes 28, followed by adhering the inner ends of the individual limbs 21 to the section 19 by the use of an adhesive sealing material. Alternatively, a wire 26 may be employed as reinforcement and adhesively secured along the main portion of each limb 21 to provide further support, with the wire 26 extending inwardly around the inner circumference of the section 19 and being attached thereto by wire staples 27 or other conventional means, as shown in FIG. 6.

The upper and lower sleeves 18 of each tubular member 17 are of a length such as about 2 to 3 inches, for example, and the sleeves 18 may be formed of metal, heavy rubber or plastic or other similar durable material and connected to the accordion-type section 19 by suitable adhesive sealing or other conventional means. A horizontally extending hole 22 is provided in each of the upper and lower sleeves 18, the hole 22 extending completely through the sleeve 18 for use in attaching the accordion-type sections 19 to the pole sections 12.

The topmost section 24 of the tree 10 will include a pole section 12 having tapered portion 13 with hole 25 but without the holes 23 for attachment of an accordion-type section 19. Instead, the topmost section 24 will have simulated tree limbs 21 secured by adhesive sealing or other suitable means directly to the topmost pole section 12, with these topmost limbs 21 of section 24 providing a conical shape in order to finish out the top of the tree 10.

In attaching the tree limb sections 16 to the pole sections 12, a tree limb section 16 is placed in position by inserting the tubular member 17 over the upper end of the pole 11 and manually pushing the section 16 down the pole 11. Upon reaching the particular pole section 12 to which it is to be attached, the accordion-type section 19 is manually expanded so that the upper and lower holes 22 of the accordion-type section 19 are aligned with the corresponding upper and lower holes 23 in the pole section 12, and a securing peg 20 is inserted through the outer hole 22 and inner hole 23, thus passing through the accordion section 19 and pole section 12 to secure the accordion-type section 19 to the respective pole section 12. The tendency for the accordion section 19 to draw together toward its naturally collapsed condition will help to maintain the peg 20 in position. The peg 20 is provided with a ring in its outer end for ease of removal of the peg 20 from the holes 22 and 23.

From the above description, it will be understood that the accordion-type section 19 should be of a length such that, upon being expanded for attachment to the pole sections 12, the section 19 will assume a relatively rigid, sturdy position for supporting and maintaining the tree limbs 21 in the desired tree-shaped configuration. Upon detachment from the pole sections 12, the tree limb section 16 will resume its collapsed configuration, thus providing for ease of removal from the pole 11 as well as easy storage of the disassembled tree 10.

Although the artificial and mechanical tree 10 of the present invention has been described as having a conical configuration, such as a Christmas tree, other configurations and shapes may be obtained by varying the size and number of the tree limb sections 16, as well as the size of the tree limbs 21.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely preferred embodiments thereof.

It is claimed:

1. An artificial and mechanical tree, comprising: a base member; a pole member secured to said base member, said pole member having attachment means located at intervals along the length thereof; and at least one accordion-type tree limb section, said tree limb section including a tubular member having at least a portion thereof constructed of a vertically collapsible and expandable accordion-type material, said tubular member having a diameter slightly larger than that of the pole member to allow the tubular member to fit over the pole member, said tubular member being concentric with said pole member and having attachment means at the upper and lower end thereof which is engageable with said attachment means of said pole member to retain the accordion-type portion of said tubular member in an expanded condition; said accordion-type portion having attached thereto a plurality of tree limbs which extend radially outwardly from said tubular member.

2. The artificial and mechanical tree of claim 1, wherein the pole member is constructed of a plurality of detachable sections.

3. The artificial and mechanical tree of claim 1 wherein the attachment means of said pole member and said tubular member includes horizontally extending holes in the upper and lower end of said tubular member which are alignable with corresponding holes in said pole member, and including a removable peg member which secures said holes in alignment so that said accordion-type portion of said tubular member assumes a vertically expanded configuration.

4. The artificial and mechanical tree of claim 1, wherein a plurality of said accordion-type tree limb sections are employed vertically along the pole member, the tree limbs of said tree limb sections being progressively shorter from bottom to top and including a topmost portion of said pole member above the upper tree limb section, said topmost portion being provided with tree limbs attached directly to said pole member to provide an artifical and mechanical tree having an overall conical configuration.

5. The artificial and mechanical tree of claim 3, wherein the pole member is constructed of a plurality of detachable sections, and wherein at least one pole section includes a horizontally extending hole at the upper and lower end thereof, which holes are alignable with corresponding holes in the upper and lower end of the tubular member.

* * * * *